US008814457B1

(12) United States Patent
Austin et al.

(10) Patent No.: US 8,814,457 B1
(45) Date of Patent: Aug. 26, 2014

(54) SOAP HOLDING AND SCRUBBING DEVICE

(76) Inventors: Judy Austin, New Castle, CO (US); Jack Austin, New Castle, CO (US)

( * ) Notice: Subject to any disclaimer, the term of this patent is extended or adjusted under 35 U.S.C. 154(b) by 519 days.

(21) Appl. No.: 13/199,758

(22) Filed: Sep. 8, 2011

Related U.S. Application Data

(60) Provisional application No. 61/403,361, filed on Sep. 14, 2010.

(51) Int. Cl.
*A47K 7/02* (2006.01)

(52) U.S. Cl.
USPC ..... 401/201

(58) Field of Classification Search
USPC ..... 401/196, 201, 205
See application file for complete search history.

(56) References Cited

U.S. PATENT DOCUMENTS

| | | | | |
|---|---|---|---|---|
| 6,048,407 | A * | 4/2000 | Schoch | 134/6 |
| 6,326,339 | B1 * | 12/2001 | Rattinger et al. | 510/140 |
| 6,659,669 | B1 * | 12/2003 | Nguyen | 401/8 |
| 6,902,338 | B2 * | 6/2005 | Puvvada et al. | 401/201 |

OTHER PUBLICATIONS

"Bath Accessories" located at http://www.chagrinvalleysoapandcraft.com/accessories.htm, copyright 2003-2011, printed from the Internet on Mar. 24, 2011, 5 pp.

* cited by examiner

*Primary Examiner* — David Walczak
(74) *Attorney, Agent, or Firm* — Mark D. Trenner; Trenner Law Firm, LLC

(57) ABSTRACT

A soap holding and scrubbing device for holding soap and allowing a user to scrub his or her body. An example soap holding and scrubbing device comprises a porous tubular housing having a first end, a second end, and an outer surface. A seam is formed in the housing with the seam extending above the outer surface of the housing. A closing mechanism closes the second end of the housing. A securing mechanism secures the soap between the seam and the second end of the housing and maintains the soap within the housing. The first end of the housing is open with the soap insertable into the housing through the first end and positionable against the closed second end. The securing mechanism is initially positioned against the seam and, as the soap dissolves, is movable in general direction toward the second end of the housing thereby maintaining the soap against the second end of the housing.

20 Claims, 3 Drawing Sheets

SOAP HOLDING AND SCRUBBING DEVICE

The present application claims benefit of priority of pending provisional patent application Ser. No. 61/403,361, filed on Sep. 14, 2010, entitled "Soap Holder and Scrubber".

BACKGROUND OF THE INVENTION

1. Field of the Invention

This invention relates generally to a soap holding and scrubbing device and, more particularly, the invention relates to a soap holding and scrubbing device for holding soap and allowing complete use of the soap until the soap is used up.

2. Description of the Prior Art

A variety of hand-held washing devices are available such as scrub brushes, sponges, and the like. These require that soap be separately applied prior to using the device. After the soap is applied, the device is used for scrubbing or otherwise distributing the soap along a user's body. This is inconvenient as it either requires the user to hold the soap in one hand and the device in the other, or requires the user to repeatedly pick up and set down the device and soap as needed.

Some designs feature integrated soap contained within the device. However, these designs are difficult for the user as the soap either cannot be refilled or is difficult to replenish once depleted. Designs that cannot be refilled are obviously not effective after they are extinguished and must be replaced by a new device. Designs that are difficult to refill may not be favored by users. Refilling of these devices is often difficult because the soap is located in the device interior that is difficult to access. Conversely, some designs feature the soap on the device exterior which is easy to access, but may result in the soap repeatedly falling out of the device, or scratching the user during use such as when the soap is contained within a fluid dispenser.

The device should further be designed such that the soap is not damaged or discharged when not in use. By way of example, the bar of soap stored within a wet Soap Holding and Scrubbing Device device will become soft and fall apart during a subsequent washing. Fluid dispensers should be able to contain the washing liquid such that it does not leak or discharge when the device is not in use.

It is also advantageous that the device be aesthetically pleasing. Washrooms and bathrooms are often fancifully decorated and users do not want to put an unattractive object within the environment. It is advantageous if the device itself can further add to the aesthetic qualities of the room.

Accordingly, there exists a need for a soap holding and scrubbing device which is easy to use and easy to refill for all soap types. Additionally, a need exists for a soap holding and scrubbing device which holds the soap completely until the soap is completely used up. Furthermore, there exists a need for a soap holding and scrubbing device which is aesthetically pleasing.

SUMMARY

The present invention is a soap holding and scrubbing device for holding soap and allowing a user to scrub his or her body. The soap holding and scrubbing device comprises a porous tubular housing having a first end, a second end, and an outer surface. A seam is formed in the housing with the seam extending above the outer surface of the housing. A closing mechanism closes the second end of the housing. A securing mechanism secures the soap between the seam and the second end of the housing and maintains the soap within the housing. The first end of the housing is open with the soap insertable into the housing through the first end and positionable against the closed second end. The securing mechanism is initially positioned against the seam and, as the soap dissolves, is movable in general direction toward the second end of the housing thereby maintaining the soap against the second end of the housing.

In addition, the present invention is a soap holding and scrubbing device for holding soap and allowing a user to scrub his or her body. The soap holding and scrubbing device comprises a porous tubular housing having a first end, a second end, and an outer surface. A seam is formed in the housing with the seam extending above the outer surface of the housing. A tightening cord extends from the second end of the housing with the tightening cord having a first cord portion and a second cord portion. A receptacle is formed on the second end of the housing with the tightening cord receivable within the receptacle. A first tightening bead is positioned over the first cord portion and the second cord portion. A first knot is formed in the tightening cord for securing the first cord portion to the second cord portion and limiting the travel extent of the first tightening bead. The first knot forms a first loop in the tightening cord between the first knot and the first tightening bead. A second knot is formed above the first knot forming a second loop in the tightening cord. A second tightening bead is positioned between the first knot and the second knot. The first end of the housing is open with the soap insertable into the housing through the first end and positionable against the closed second end. Upon pulling the tightening cord tight, the second end of the housing bunches together thereby decreasing the width of the second end. The first tightening bead is securable against the bunched housing maintaining the second end of the housing in the bunched condition. The first end of the housing is positioned through the first loop with the tightening cord initially positioned against the seam. The second tightening bead is tightened against the housing thereby closing the first end of the housing. As the soap dissolves, the tightening cord is movable in general direction toward the second end of the housing thereby maintaining the soap against the second end of the housing.

The present invention further includes a method for holding soap and allowing a user to scrub his or her body. The method comprises providing a porous tubular housing having a first end, a second end, and an outer surface, forming a seam in the housing, extending the seam above the outer surface of the housing, closing the second end of the housing, inserting the soap into the housing through the first end, positioning the soap against the closed second end, securing the soap into an area of the housing between the seam and the second end of the housing, continually shrinking the area of the housing as the soap dissolves, and maintaining the soap against the second end of the housing.

DETAILED DESCRIPTION OF THE PREFERRED EMBODIMENTS

Figure 1:
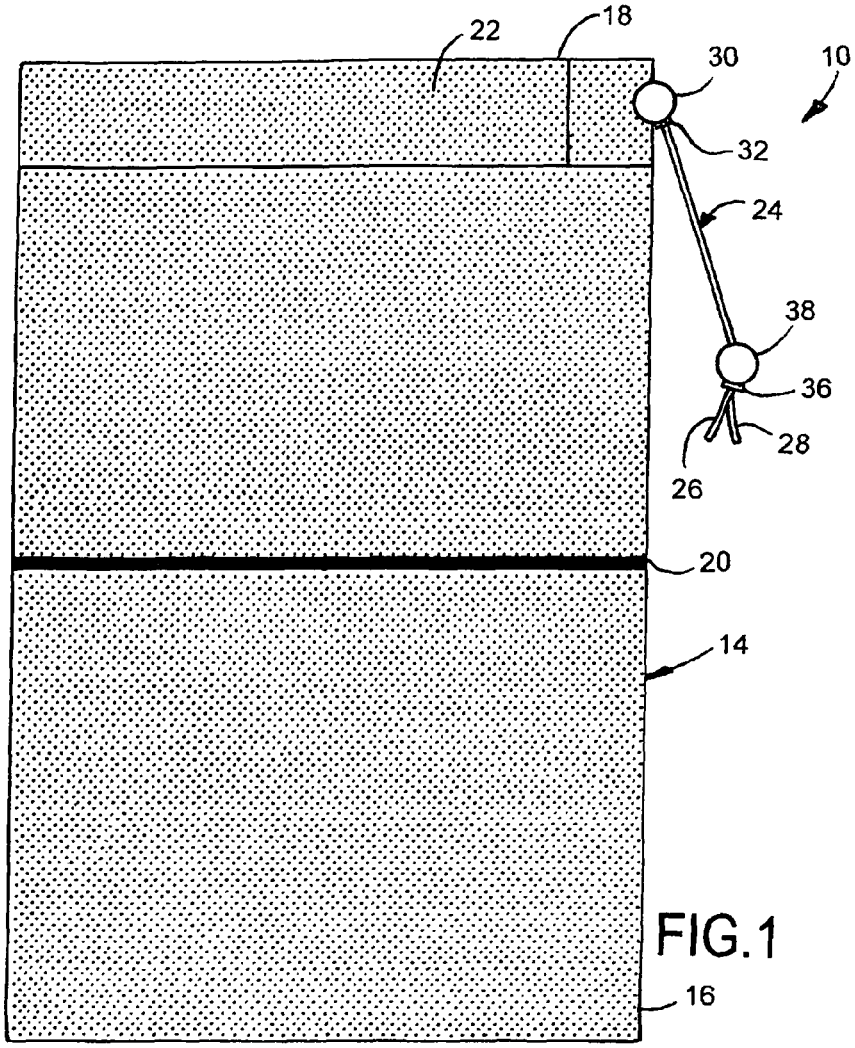
FIG. 1 is a an elevational side view illustrating a soap holding and scrubbing device, constructed in accordance with the present invention.
Figure 2:
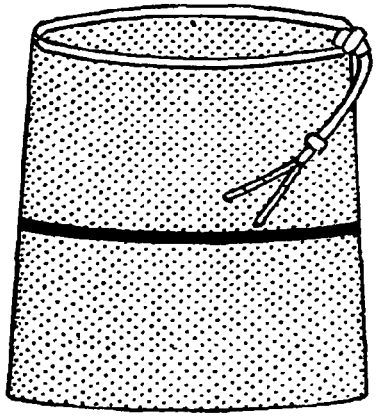
FIG. 2 is an elevational side view illustrating an embodiment of the soap holding and scrubbing device, constructed in accordance with the present invention, with the device having a folded edge at a first end.
Figure 3:
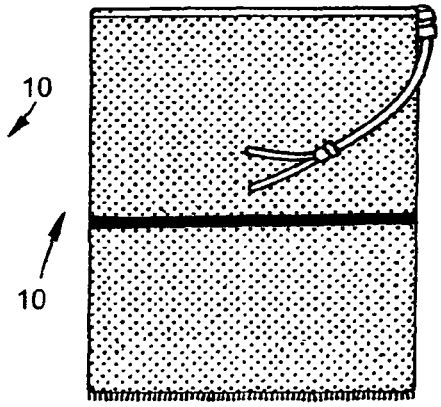
FIG. 3 is an elevational side view illustrating still another embodiment of the soap holding and scrubbing device, constructed in accordance with the present invention, with the device having a fringed edge at the first end.
Figure 4A:
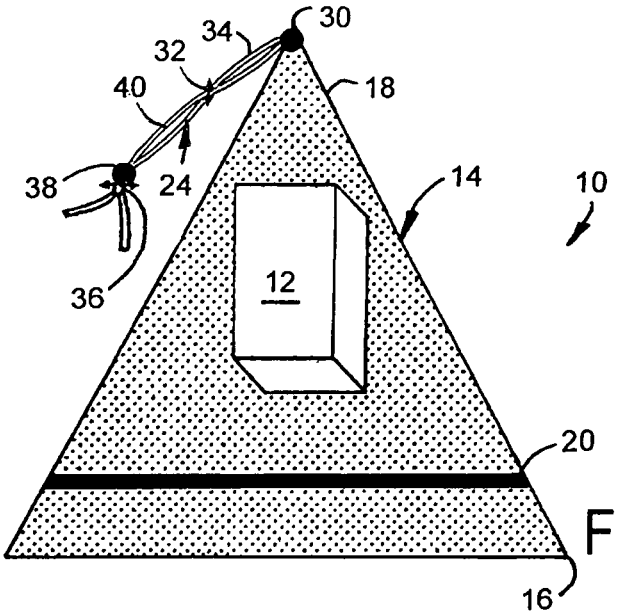
FIGS. 4*a*-4*d* are a series of elevational side views illustrating the process of inserting a bar of soap into the soap holding and scrubbing device, constructed in accordance with the present invention.
Figure 4B:
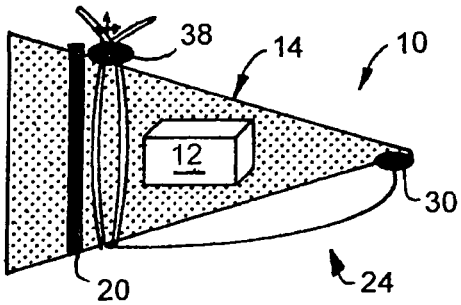
Figure 4C:
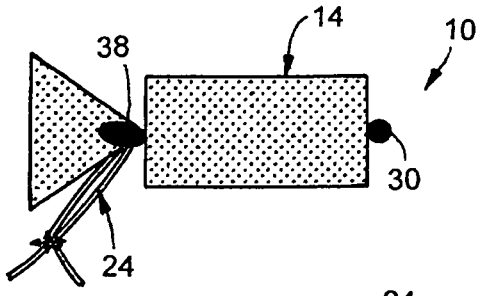
Figure 4D:
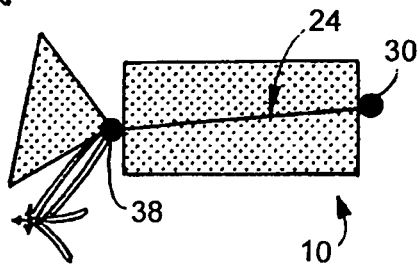
Figure 5A:
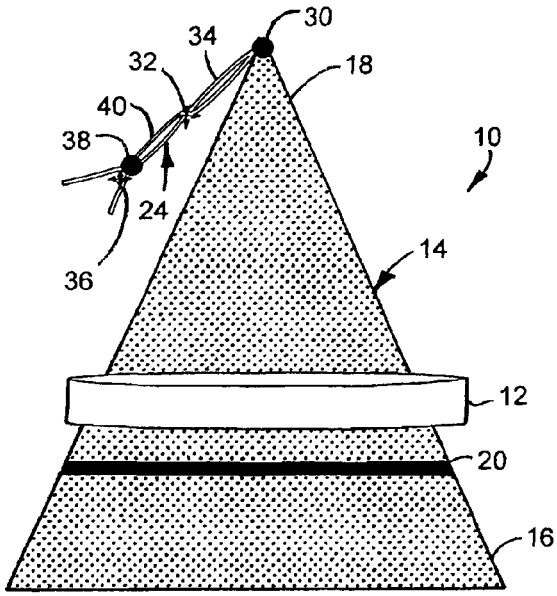
FIG. 5 *a*-5*e* are a series of elevational side views illustrating the process of inserting a round soap into the soap holding and scrubbing device, constructed in accordance with the present invention, with the round soap having a hole in the middle.
Figure 5B:
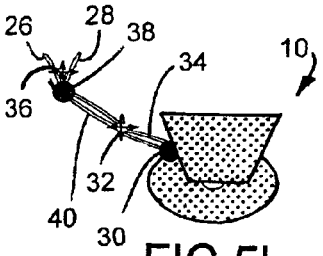
Figure 5C:
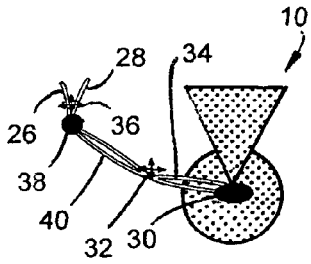
Figure 5D:
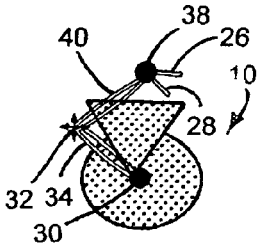
Figure 5E:
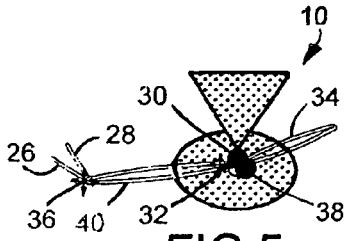

As illustrated in FIGS. 1-5, the present invention is a soap holding and scrubbing device, indicated generally as 10, for holding soap 12 and allowing complete use of the soap 12 until the soap 12 is used up. The soap holding and scrubbing device 10 of the present invention is usable with all types of soap 12 including, but not limited to, bar soap, round soap, round soap with a hole, liquid soap within a porous dispenser, etc.

The soap holding and scrubbing device 10 of the present invention includes a tubular housing 14 for holding the soap 12 with the housing 14 having a first end 16 and a second end 18. The housing 14 is preferably constructed of a durable, pliable, fabric mesh material although constructing the housing 14 from other porous materials is within the scope of the present invention. A seam 20 is formed by doubling the first end 16 of the housing material back upon the housing 14 and sewing the first end 16 of the housing 14 to a point on the housing 14. The first end 16 remains open for receiving the soap 12, as will be described in further detail below.

In an alternative embodiment of the soap holding and scrubbing device 10 of the present invention, the seam 20 is formed by sewing or otherwise securing two or more pieces of material together. In both embodiments, the seam 20 creates a "washer" to hold the soap 12 adjacent the second end 18, as will be described in further detail below.

The position of the seam 20 of the soap holding and scrubbing device 10 of the present invention is preferably positioned at a location closer to the first end 16 as compared to the second end 18. By positioning the seam 20 as described and illustrated, the area of the housing 14 for receiving the soap 12 is sized for receiving larger soap. It should be noted, however, that the seam 20 can be positioned anywhere on the housing 14 and should not be limited by the description and illustrations herein.

As briefly mentioned above, the first end 16 of the housing 14 of the soap holding and scrubbing device 10 of the present invention is open allowing soap 12 to be inserted into the tubular housing 14 through the first end 16 of the housing 14. The second end 18 of the housing 14 can be either open or closed. In the open second end embodiment, the second end 18 is folded back onto the housing 14 and sewn thereto forming a receptacle 22 for receiving a tightening cord 24. The tightening cord 24 has a first cord portion 26 and a second cord portion 28 extending from the receptacle 22. A first tightening bead 30 is positioned over the first cord portion 26 and the second cord portion 28. The tightening cord 24 can be pulled tight causing the second end 18 of the housing 14 to bunch together thereby decreasing the width of the second end 18. The first tightening bead 30 is securable against the bunched housing 14 maintaining the second end 18 of the housing 14 in the bunched condition. Preferably, the tightening cord 24 is an elastic cord although having the tightening cord 24 be non-elastic is within the scope of the present invention.

In the closed second end embodiment of the soap holding and scrubbing device 10 of the present invention, the second end 18 of the housing 14 is sewn closed with the second end 18 of the housing 14 bunched or otherwise formed into a narrow point or the like, similar to the bunching of the first embodiment with the tightening cord 24. In this embodiment, the second end 18 is in a fixed closed position and the first cord portion 26 and the second cord portion 28 of the tightening cord 24 extend from the bunched second end 18. As stated above, actual operation and use of the soap holding and scrubbing device 10 will be described in further detail below.

The soap holding and scrubbing device 10 of the present invention further includes a first knot 32 formed in the tightening cord 24 securing the first cord portion 26 to the second cord portion 28 and limiting the travel extent of the first tightening bead 30. The first knot 32 forms a first loop 34 in the tightening cord 24 between the first knot 32 and the first tightening bead 30. A second knot 36 is formed above the first knot 32 forming a second loop 40 in the tightening cord 24. A second tightening bead 38 is positioned between the first knot 32 and the second knot 36. Actual use and operation of the first loop 34, the second loop 40, the knots 32, 36, the first tightening bead 30, and the second tightening bead 38 will now be described further below.

The manner of use of the soap holding and scrubbing device 10 of the present invention will now be described. It will be understood by those skilled in the art that the manner of use of the soap holding and scrubbing device 10 described herein is merely one method of use and other methods of use of the soap holding and scrubbing device 10 are within the scope of the present invention.

For purposes of example only, the manner of use of the soap holding and scrubbing device 10 of the present invention will be described for two different soap types: bar soap and round soap with a hole. It should be noted that the soap holding and scrubbing device 10 can be used with a variety of different soaps 12 including, but not limited to, liquid soap in a porous dispenser.

To use the soap holding and scrubbing device 10 of the present invention with bar soap, in the case of the second open end, the user first tightens the tightening cord 24 at the second end 18 of the housing 14 and manipulates the first tightening bead 30 against the bunched material thereby effectively closing the second end 18 of the housing 14. Next, the user inserts the bar soap into the tubular housing 14 through the open first end 16. The second tightening bead 38 is then positioned directly against the second knot 36 and the first end 16 of the housing 14 is then pulled through the second loop 40 formed in the tightening cord 24 between the first knot 32 and the second knot 36. Then, the second tightening bead 38 is tightened against the housing 14 directly adjacent the seam 20 and between the seam 20 and the second end 18 of the housing 14. The seam 20 inhibits movement of the second loop 40 toward the first end 16 of the housing 14. As the soap 12 gets smaller through use, the user continually moves the second tightening bead 38 in a general direction toward the second end 18. Once the soap 12 disappears, the user can then disassemble the soap holding and scrubbing device 10 and insert a new bar soap using the process as described immediately above.

To use the soap holding and scrubbing device 10 of the present invention with round soap having a hole formed therethrough, in the case of the second open end, the user first tightens the tightening cord 24 at the second end 18 of the housing 14 and manipulates the first tightening bead 30 against the bunched material thereby effectively closing the second end 18 of the housing 14. Next, the second end 18 of the housing 14 is manipulated through the hole in the soap 12 above the seam 20. The tightening cord 24 at second end 18 of housing 14 is loosen with the first tightening bead 30 to allow the housing 14 at the second end 18 to be wrapped upward around the soap 12 adjacent the seam 20 securing the soap 12 between the seam 20 and the second end of the housing 14. Then, the tightening cord 24 at the second end 18 of the housing 12 is tightened against the housing 14 by manipulating the first tightening bead 30 against the material adjacent the seam 20. Once again, the seam 20 inhibits movement of the tightening cord 24 toward the first end 16 of the housing 14. If wanted, the user can next insert the first end 16 of the housing 14 through the second loop 40 and tighten the second tightening bead 38 against the housing 14 thereby reducing the amount of the excess tightening cord 24. As the soap 12 gets smaller through use, the user continually moves the first tightening bead 30 in a general direction away from the first end 16. If the excess amount of the tightening cord 24 is reduced, the user tightens the beads 30 and 38 in a general direction away from the first end 16. Once the soap 12 disappears, the user can then disassemble the soap holding and scrubbing device 10 and insert a new round soap using the process as described immediately above.

The soap holding and scrubbing device 10 of the present invention keeps the soap 12 in place to the end of the soap's life. A user can continue to tighten the soap holding and scrubbing device 10 against the soap 12 as the soap 12 gets smaller. Even the small pieces of soap 12 at the end stay in place and are easy to use as they dissolve. The one-piece design of the soap holding and scrubbing device 10 makes it easy to load the soap 12. The first end 16 of the housing 14 extends above the soap 12 making the soap holding and scrubbing device 10 easy to hold and has a unique seam washer 20 designed to hold the soap 12 in place when the tightening cord 24 is pulled tight. The first end 16 of the housing 14 not only makes it easier to hold but also functions as a small wash cloth. The tightening cord 24 not only holds the soap 12 tight against the second end 18, but allows a user to hang it on a hook or faucet which means they do not have to set the soap holding and scrubbing device 10 on the side of a tub or soap dish helping prevent the soap 12 from dissolving faster. With the durable mesh fabric of the housing, the soap holding and scrubbing device 10 can be constructed with a variety of thread patterns, material finishes, cords, and closing mechanisms, but not limited to beads that are illustrated. The versatility of the mesh offers the opportunity to use the soap holding and scrubbing device 10 for many cleaning applications, not just in the bath tub and not just on people. The pattern of the material of the housing can be adjusted to accommodate different diameters, thickness and overall sizes of soap 12. The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A soap holding and scrubbing device for holding soap and allowing a user to scrub his or her body, the soap holding and scrubbing device comprising:

a porous tubular housing having a first end, a second end, and an outer surface;

a seam formed in the housing, the seam extending above the outer surface of the housing;

closing means for closing the second end of the housing; and securing means for securing the soap between the seam and the second end of the housing and maintaining the soap within the housing;

wherein the first end of the housing is open, the soap insertable into the housing through the first end and positionable against the closed second end;

wherein the securing means is initially positioned against the seam and, as the soap dissolves, movable in general direction toward the second end of the housing thereby maintaining the soap against the second end of the housing.

2. The soap holding and scrubbing device of claim 1 wherein the housing is constructed of a durable, pliable, fabric mesh material.

3. The soap holding and scrubbing device of claim 1 wherein the seam is formed by doubling the first end of the housing material back upon the housing and sewing the first end of the housing to the outer surface of the housing.

4. The soap holding and scrubbing device of claim 1 wherein the seam is formed by sewing two or more pieces of material together.

5. The soap holding and scrubbing device of claim 1 wherein the seam is positioned at a location closer to the first end of the housing.

6. The soap holding and scrubbing device of claim 1 and further comprising: a tightening cord extending from the second end of the housing, the tightening cord having a first cord portion and a second cord portion.

7. The soap holding and scrubbing device of claim 6 wherein the tightening cord is an elastic cord.

8. The soap holding and scrubbing device of claim 6 wherein the closing means comprises:

a receptacle formed on the second end of the housing, the tightening cord receivable within the receptacle;

a first tightening bead positioned over the first cord portion and the second cord portion;

wherein upon pulling the tightening cord tight, the second end of the housing bunches together thereby decreasing the width of the second end;

wherein the first tightening bead is securable against the bunched housing maintaining the second end of the housing in the bunched condition.

9. The soap holding and scrubbing device of claim 6 wherein the closing means is thread for sewing the second end of the housing into a narrow point, the first cord portion and the second cord portion of the tightening cord extending from a bunched second end.

10. The soap holding and scrubbing device of claim 6 and further comprising:

a first knot formed in the tightening cord securing the first cord portion to the second cord portion and limiting the travel extent of the first tightening bead, the first knot forming a first loop in the tightening cord between the first knot and the first tightening bead.

11. The soap holding and scrubbing device of claim 10 and further comprising:

a second knot formed above the first knot forming a second loop in the tightening cord; and a second tightening bead positioned between the first knot and the second knot.

12. The soap holding and scrubbing device of claim 11 and further comprising:

a bar of soap;

wherein upon positioning the soap within the housing, the first end of the housing is positioned within the second loop and the second tightening bead is moved against the housing thereby closing the first end of the housing.

13. The soap holding and scrubbing device of claim 11 and further comprising:

a round soap; and an aperture formed in the round soap;

wherein upon tightening the tightening cord at the second end of the housing and manipulating the first tightening bead against the bunched second end thereby effectively closing the second end of the housing, the second end of the housing is manipulated through the hole in the soap above the seam;

further wherein the second end of the housing is opened allowing it to be wrapped around the soap adjacent the seam thereby securing the soap between the seam and the second end of the housing; and further wherein the tightening cord at the second end of the housing is tightened against the housing by manipulating the first tightening bead against the material adjacent the seam.

14. A soap holding and scrubbing device for holding soap and allowing a user to scrub his or her body, the soap holding and scrubbing device comprising:

a porous tubular housing having a first end, a second end, and an outer surface;

a seam formed in the housing, the seam extending above the outer surface of the housing;

a tightening cord extending from the second end of the housing, the tightening cord having a first cord portion and a second cord portion;

a receptacle formed on the second end of the housing, the tightening cord receivable within the receptacle;

a first tightening bead positioned over the first cord portion and the second cord portion;

a first knot formed in the tightening cord securing the first cord portion to the second cord portion and limiting the travel extent of the first tightening bead, the first knot forming a first loop in the tightening cord between the first knot and the first tightening bead;

a second knot formed above the first knot forming a second loop in the tightening cord; and a second tightening bead positioned between the first knot and the second knot;

wherein the first end of the housing is open, the soap insertable into the housing through the first end and positionable against the closed second end;

wherein upon pulling the tightening cord tight, the second end of the housing bunches together thereby decreasing the width of the second end;

wherein the first tightening bead is securable against the bunched housing maintaining the second end of the housing in the bunched condition;

wherein the second end of the housing is positioned through the first loop with the tightening cord initially positioned against the seam;

wherein the second tightening bead is tightened against the housing thereby closing the first end of the housing; and wherein, as the soap dissolves, the tightening cord is movable in general direction toward the second end of the housing thereby maintaining the soap against the second end of the housing.

15. A method for holding soap and allowing a user to scrub his or her body, the method comprising:

providing a porous tubular housing having a first end, a second end, and an outer surface;

providing means for closing the second end of the housing;

receiving the soap in the housing through the first end and against the closed second end;

securing the soap into an area of the housing between the first and the second end of the housing;

continually shrinking the area of the housing as the soap dissolves while maintaining the soap against the second end of the housing.

16. The method of claim 15 and further comprising:

positioning a seam at a location closer to the first end of the housing.

17. The method of claim 15 and further comprising:

forming a receptacle on the second end of the housing;

extending a tightening cord through the receptacle, the tightening cord having a first cord portion and a second cord portion extending from the receptacle;

positioning a first tightening bead over the first cord portion and the second cord portion;

forming a first knot formed in the tightening cord;

creating a first loop in the tightening cord between the first knot and the first tightening bead;

pulling the tightening cord tight;

bunching the second end of the housing together;

decreasing the width of the second end;

securing the first tightening bead against the bunched housing; and maintaining the second end of the housing in the bunched condition.

18. The method of claim 17 wherein the tightening cord is an elastic cord.

19. The method of claim 17 and further comprising:

providing a bar of soap;

forming a second knot above the first knot;

creating a second loop in the tightening cord between the first knot and the second knot;

positioning a second tightening bead between the first knot and the second knot;

positioning the soap within the housing; positioning the first end of the housing within the second loop;

moving the second tightening bead against the housing; and closing the first end of the housing.

20. The method of claim 17 and further comprising:

providing a round soap;

forming an aperture in the round soap;

tightening the tightening cord at the second end of the housing by manipulating the first tightening bead against the bunched material thereby effectively closing the second end of the housing;

manipulating the second end of the housing through the hole in the soap above a seam;

opening the second end of the housing;

wrapping the second end of the housing around the soap adjacent the seam thereby securing the soap between the seam and the second end of the housing; and tightening the tightening cord at the second end of the housing against the housing by manipulating the first tightening bead against the material adjacent the seam.

* * * * *

UNITED STATES PATENT AND TRADEMARK OFFICE

CERTIFICATE OF CORRECTION

PATENT NO. : 8,814,457 B1
APPLICATION NO. : 13/199758
DATED : August 26, 2014
INVENTOR(S) : Judy Austin et al.

It is certified that error appears in the above-identified patent and that said Letters Patent is hereby corrected as shown below:

In the Specification

In the Background of the Invention, Column 1, Lines 38-39, "the bar of soap stored within a wet Soap Holding and Scrubbing Device device" should read --the bar of soap stored within a wet device--.

Signed and Sealed this
Twenty-fifth Day of November, 2014

Michelle K. Lee

Michelle K. Lee
*Deputy Director of the United States Patent and Trademark Office*